United States Patent [19]

Bleil et al.

[11] Patent Number: 4,704,221

[45] Date of Patent: Nov. 3, 1987

[54] GRANULAR DETERGENTS WHICH CONTAIN HIGH LEVELS OF ANIONIC SURFACTANT THAT FORMS A MIDDLE-PHASE, SURFACE TREATED WITH A WATER SOLUBLE CATIONIC SURFACTANT

[75] Inventors: Charles F. Bleil, Fairfield; John E. Morrow, Terrace Park, both of Ohio

[73] Assignee: The Procter & Gamble Company, Cincinnati, Ohio

[21] Appl. No.: 921,936

[22] Filed: Oct. 22, 1986

[51] Int. Cl.[4] ..... C11D 1/65; C11D 11/00; C11D 11/02; C11D 17/06

[52] U.S. Cl. ..... 252/91; 252/174; 252/174.13; 252/174.25; 252/363.5; 252/528; 252/531; 252/539; 252/547; 252/550; 252/558

[58] Field of Search ..... 252/8.8, 110, 174, 174.13, 252/363.5, 528, 547, 91, 531, 539, 550, 558

[56] References Cited

U.S. PATENT DOCUMENTS

| | | | |
|---|---|---|---|
| 2,329,694 | 9/1943 | Bodman | 252/368 |
| 2,423,451 | 7/1947 | Holuba | 252/109 |
| 2,456,437 | 12/1948 | Miles | 252/368 |
| 2,465,346 | 3/1949 | Bodman | 252/109 |
| 2,592,535 | 4/1952 | Bodman | 260/398.5 |
| 2,776,943 | 1/1957 | Eaton | 252/109 |
| 2,940,935 | 6/1960 | Reich et al. | 252/109 |
| 3,142,647 | 7/1964 | Glasgow | 252/363.5 |
| 3,451,935 | 6/1969 | Roald et al. | 252/135 |
| 3,862,058 | 1/1975 | Nirschl | 252/528 |
| 3,886,098 | 5/1975 | DiSalvo et al. | 252/540 |
| 3,993,573 | 11/1976 | Gloss | 252/8.8 |
| 4,291,071 | 9/1981 | Harris | 427/220 |
| 4,294,711 | 10/1981 | Hardy | 252/8.75 |
| 4,298,480 | 11/1981 | Wixon | 252/8.75 |
| 4,466,897 | 8/1984 | Appel et al. | 252/108 |
| 4,632,768 | 12/1986 | Atkinson | 252/8.8 |

*Primary Examiner*—Dennis Albrecht

*Attorney, Agent, or Firm*—Donald E. Hasse; Robert B. Aylor; Thomas H. O'Flaherty

[57] ABSTRACT

Detergent granules containing more than about 18% of anionic surfactant that forms a sticky middle phase are surface treated with a small amount of a water soluble quaternary ammonium salt in an aqueous solution to improve the dissolving characteristics of the composition.

6 Claims, No Drawings

GRANULAR DETERGENTS WHICH CONTAIN HIGH LEVELS OF ANIONIC SURFACTANT THAT FORMS A MIDDLE-PHASE, SURFACE TREATED WITH A WATER SOLUBLE CATIONIC SURFACTANT

TECHNICAL FIELD

The present invention relates to granular detergent compositions containing high levels of anionic surfactant which form a middle phase. Preferably the detergent composition is spray-dried. The compositions are prepared by forming an aqueous slurry of anionic surfactant and inorganic salts and then spray-drying the slurry. The granules are then sprayed with aqueous solutions of the indicated surface modifier, which allows the granular detergent compositions to dissolve or disperse more rapidly in a laundering solution.

Granular detergents made using conventional spray-drying processes generally have satisfactory solubility, if the individual components are soluble or dispersible in water, due to their substantial porosity. However, spray-dried detergents containing high levels of anionic surfactants often have low solubility rates because anionic surfactants tend to form a sticky middle-phase when they contact the laundering solution. This can result in noticeable undissolved detergent globs on fabrics.

The primary object of the present invention is to improve the solubility of spray-dried granular detergents containing high levels of anionic surfactants which form a middle-phase. The invention is, however, also applicable to granular detergents made by agglomerating high levels of the same anionic surfactants with a neutral or alkaline salt.

SUMMARY OF THE INVENTION

The present invention encompasses granular detergent compositions comprising:

(a) from about 18% to about 50% by weight of anionic surfactant which forms a middle-phase;

(b) from about 30% to about 75% by weight of other detergent ingredients including water-soluble neutral or alkaline salts, or mixtures thereof; and (c) said composition being surface treated with from about 0.1% to about 2.0%, preferably from about 0.5% to about 1.0%, of water soluble quaternary ammonium salt preferably containing a long alkyl group containing from about 10 to about 14 carbon atoms and three short alkyl groups each of which contains no more than about 2 carbon atoms, preferably the total number of carbon atoms preferably being from about 13 to about 17, said quaternary ammonium salt preferably being applied in the form of an aqueous solution.

DETAILED DESCRIPTION OF THE INVENTION

The granular detergent compositions of the present invention contain at least about 18% of at least one anionic surfactant that forms a sticky middle phase and a major portion of water-soluble neutral or alkaline salt. The compositions are preferably prepared by forming a slurry of the anionic surfactants and neutral or alkaline salts and spray drying. Granule formation can also be accomplished by agitating in the presence of a suitable binder or by mechanically mixing under pressure (e.g., extruding, pressing, milling, compacting or pelletizing).

Anionic Surfactant

The detergent compositions herein contain from about 18% to about 50% by weight of anionic surfactant, or mixtures thereof. The anionic surfactant preferably represents from about 18% to about 40%, and more preferably from about 20% to about 30%, by weight of the detergent composition. Anionic surfactants useful herein are disclosed in U.S. Pat. No. 3,664,961, Norris, issued May 23, 1972, and in U.S. Pat. No. 3,919,678, Laughlin et al, issued Dec. 30, 1975, both incorporated herein by reference.

Useful anionic surfactants include the water-soluble salts, particularly the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of aryl groups.) Examples of this group of synthetic surfactants are the sodium and potassium alkyl sulfates, especially those obtained by sulfating the higher alcohols ($C_8$–$C_{18}$ carbon atoms) such as those produced by reducing the glycerides of tallow or coconut oil; and the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 13, abbreviated as $C_{11-13}$LAS.

Water-soluble salts of 2-acyloxy-alkane-1-sulfonic acids containing from about 2 to 9 carbon atoms in the acyl group and from about 9 to about 23 carbon atoms in the alkane moiety; water-soluble salts of olefin sulfonates containing from about 12 to 24 carbon atoms; and $\beta$-alkyloxy alkane sulfonates containing from about 1 to 3 carbon atoms in the alkyl group and from about 8 to 20 carbon atoms in the alkane moiety.

Water-soluble salts of the higher fatty acids, i.e., "soaps", also are useful anionic surfactants herein. Soaps can be made by direct saponification of fats and oils or by the neutralization of free fatty acids. Examples of soaps are the sodium, potassium, ammonium, and alkylolammonium salts of higher fatty acids containing from about 8 to about 24 carbon atoms, and preferably from about 12 to about 18 carbon atoms. Particularly useful are the sodium and potassium salts of the mixtures of fatty acids derived from coconut oil and tallow, i.e., sodium or potassium tallow and coconut soaps.

Particularly preferred anionic surfactants are the alkali metal (especially sodium) salts of $C_{11-13}$ alkylbenzene sulfonates, $C_{14-18}$ alkyl sulfates, and mixtures thereof.

The Quaternary Ammonium Salt

The quaternary ammonium salt is one which dissolves readily in water. It is preferably one that also contributes to detergency, i.e., one long alkyl group contains from about 8 to about 18, preferably from about 10 to about 14 carbon atoms, and the three shorter alkyl groups contain no more than 2 carbon atoms, the total number of carbon atoms preferably being from about 13 to about 17.

The short alkyl groups can also contain a hydroxy group in place of a hydrogen atom. Suitable examples of quaternary ammonium salts are coconut alkyl trimethyl ammonium chloride, acetate, or sulfate and dodecyl trimethyl ammonium chloride, acetate or sulfate. Mixtures of salts are useful and desirable.

Water-Soluble Neutral or Alkaline Salt

The granular detergents of the present invention also contain from about 30% to about 75%, preferably from about 40% to about 60%, and more preferably from about 45% to about 50%, by weight of one or more water-soluble neutral or alkaline salts. Neutral or alkaline salts have a pH in solution of about seven or greater, and can be either organic or inorganic in nature. The salt assists in providing the desired density and bulk to the detergent granules herein. While some of the salts are inert, many of them also function as detergency builder materials in the laundering solution. Preferably, the salts are inorganic.

Examples of neutral water-soluble salts include the alkali metal, ammonium or substituted ammonium chlorides and sulfates. The alkali metal, and especially sodium, salts of the above are preferred. Sodium sulfate is typically found in detergent granules and is a preferred salt herein. It is usually formed during the sulfation/sulfonation and neutralization steps in the production of anionic synthetic surfactants.

Other useful water-soluble salts include the compounds commonly known as detergent builder materials. Builders are generally selected from the various water-soluble, alkali metal, ammonium or substituted ammonium phosphates, polyphosphates, phosphonates, polyphosphonates, carbonates, silicates, borates, polyhydroxy sulfonates, polyacetates, carboxylates, and polycarboxylates. Preferred are the alkali metal, especially sodium, salts of the above.

Specific examples of inorganic phosphate builders are sodium and potassium tripolyphosphate, pyrophosphate, polymeric metaphosphate having a degree of polymerization of from about 6 to 21, and orthophosphate. Examples of polyphosphonate builders are the sodium and potassium salts of ethylene diphosphonic acid, the sodium and potassium salts of ethane 1-hydroxy-1,1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176; and 3,400,148, incorporated herein by reference.

Examples of nonphosphorus, inorganic builders are sodium and potassium carbonate, bicarbonate, sesquicarbonate, tetraborate decahydrate, and silicates having a weight ratio of $SiO_2$ to alkali metal oxide of from about 0.5 to about 4.0, preferably from about 1.0 to about 2.4.

Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylenediaminetetraacetic acid, nitrilotriacetic acid, oxydisuccinic acid, mellitic acid, benzene polycarboxylic acids, and citric acid. Salts of nitrilotriacetic acid, such as sodium nitrilotriacetate, are particularly preferred.

Polymeric polycarboxylate builders are set forth in U.S. Pat. No. 3,308,067, Diehl, issued Mar. 7, 1967, incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid.

Other useful builders herein are sodium and potassium carboxymethyloxymalonate, carboxymethyloxysuccinate, cis-cyclohexanehexacarboxylate, cis-cyclopentanetetracarboxylate, phloroglucinol trisulfonate, and the copolymers of maleic anhydride with vinyl methyl ether or ethylene.

Other suitable polycarboxylates for use herein are the polyacetal carboxylates described in U.S. Pat. No. 4,144,226, issued Mar. 13, 1979 to Crutchfield et al, and U.S. Pat. No. 4,246,495, issued Mar. 27, 1979 to Crutchfield et al, both incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution and converted to the corresponding salt.

The neutral or alkaline salt of the present invention is preferably selected from alkali metal polyphosphates, nitrilotriacetates, carbonates, silicates, sulfates, and mixtures thereof.

Optional Components

Other ingredients commonly used in detergent compositions can be included in the compositions of the present invention. These include auxiliary detergent surfactant and builder materials, color speckles, bleaching agents, and bleach activators, suds boosters or suds suppressors, anti-tarnish and anti-corrosion agents, soil suspending agents, soil release agents, dyes, fillers, optical brighteners, germicides, pH adjusting agents, non-builder alkalinity sources, enzymes, enzyme-stabilizing agents and perfumes.

An optional builder herein is a water-insoluble crystalline or amorphous aluminosilicate ion exchange material. The preferred crystalline material useful herein is of the formula $$Na_z[(AlO_2)_z.(SiO_2)_y].xH_2O$$

wherein z and y are at least about 6, the molar ratio of z to y is from about 1.0 to about 0.5 and x is from about 10 to about 264. Amorphous hydrated aluminosilicate materials useful herein have the empirical formula $$M_z(_zAlO_2.ySiO_2)$$

wherein M is sodium, potassium, ammonium or substituted ammonium, z is from about 0.5 to about 2 and y is 1, said material having a magnesium ion exchange capacity of at least about 50 milligram equivalents of $CaCO_3$ hardness per gram of anhydrous aluminosilicate.

The aluminosilicate ion exchange builder materials herein are in hydrated form and contain from about 10% to about 28% of water by weight if crystalline, and potentially even higher amounts of water if amorphous. Highly preferred crystalline aluminosilicate ion exchange materials contain from about 18% to about 22% water in their crystal matrix. The crystalline aluminosilicate ion exchange materials are further characterized by a particle size diameter of from about 0.1 micron to about 10 microns. Amorphous materials are often smaller, e.g., down to less than about 0.01 micron. Preferred ion exchange materials have a particle size diameter of from about 0.2 micron to about 4 microns. The term "particle size diameter" herein represents the average particle size diameter of a given ion exchange material as determined by conventional analytical techniques such as, for example, microscopic determination utilizing a scanning electron microscope. The crystalline aluminosilicate ion exchange materials herein are usually further characterized by their calcium ion exchange capacity, which is at least about 200 mg equivalent of $CaCO_3$ water hardness/g of aluminosilicate, calculated on an anhydrous basis, and which generally is in the range of from about 300 mg eq./g to about 352 mg eq./g The aluminosilicate ion exchange materials herein are still further characterized by their calcium ion exchange rate which is at least about 2 grains/gallon/minute/-gram/gallon of aluminosilicate (anhydrous basis), and generally lies within the range of from about 2 to 6 grains/gallon/minute/gram/gallon, based on calcium ion hardness. Optimum aluminosilicate for builder purposes exhibit a calcium ion exchange rate of at least about 4 grains/gallon/minute/gram/gallon.

The amorphous aluminosilicate ion exchange materials usually have a $Mg^{++}$ exchange capacity of at least about 50 mg. eq. $CaCO_3$/g (12 mg $Mg^{++}$/g) and a $Mg^{++}$ exchange rate of at least about 1 grain/gallon/-minute/gram/gallon. Amorphous materials do not exhibit an observable diffraction pattern when examined by Cu radiation (1.54 Angstrom Units).

Aluminosilicate ion exchange materials useful in the practice of this invention are commercially available. The aluminosilicates useful in this invention can be crystalline or amorphous in structure and can be naturally-occurring aluminosilicates or synthetically derived. A method for producing aluminosilicate ion exchange materials is discussed in U.S. Pat. No. 3,985,669, Krummel, et al., issued Oct. 12, 1976, incorporated herein by reference. Preferred synthetic crystalline aluminosilicate ion exchange materials useful herein are available under the designations Zeolite A, Zeolite B, and Zeolite X. In an especially preferred embodiment, the crystalline aluminosilicate ion exchange material has the formula $$Na_{12}[AlO_2)_{12}(SiO_2)_{12}].xH_2O$$

wherein x is from about 20 to about 30, especially about 27.

The following non-limiting example illustrates the detergent compositions of the present invention.

All percentages, parts, and ratios used herein are by weight unless otherwise specified.

EXAMPLE

Spray dried detergent granules were prepared containing 20% of a 1:1 mixture of sodium $C_{13}$ linear alkyl benzene sulfonate and sodium $C_{14-15}$ alkyl sulfate; 24.4% of hydrated sodium Zeolite A; 1.8% of 1.6 ratio sodium silicate; 5% sodium carbonate; 36.2% sodium sulfate; 1.5% sodium acrylate (4500 molecular weight); 1.1% sodium tallow soap; 1.5% polyethylene glycol (8000 molecular weight); and the balance moisture and minors. These granules (A) were the control. They were compared with granules that were surface treated with 0.1% (B); 0.25% (C); 0.5% (D) and 1% (E) aqueous solutions respectively of $C_{12}$ alkyl trimethyl ammonium chloride in a "pocket solubility" test. In this test, prewashed pockets containing approximately ¼ of the recommended usage were closed and placed in a washing machine containing 17.5 gal. of city water. After the pockets sink, the washer is placed on the gentle cycle for 10 minutes. The pockets are then opened, spread out to dry and evaluated using a scale in which 0 is fabric almost completely covered with undissolved detergent and 7 is fabric showing no evidence of undissolved detergent. The results were as follows:

| | TEMPERATURE (°F.) | | | | | |
|---|---|---|---|---|---|---|
| | 40° | 50° | 60° | 65° | 70° | 80° |
| (A) 0.00 | 1.25 | 1.75 | 1.25 | 2.60 | 5.20 | 6.50 |
| (B) 0.10 | — | 0.50 | 1.25 | 4.50 | 6.75 | — |
| (C) 0.25 | — | 0.25 | 2.10 | 4.25 | 6.75 | — |
| (D) 0.50 | 3.00 | 3.00 | 6.00 | — | 6.75 | — |
| (E) 1.00 | 4.25 | 6.25 | 6.25 | — | 7.00 | — |

What is claimed is:

1. A granular detergent composition of improved solubility comprising:

(a) from about 18% to about 50% by weight of anionic surfactant which forms a sticky middle-phase;

(b) from about 50% to about 85% by weight of other detergent ingredients; and (c) said composition being surface treated with from about 0.1% to about 2% of water soluble quaternary ammonium salt in the form of an aqueous solution, wherein said water soluble quaternary ammonium salt contains a long alkyl group containing from about 10 to about 14 carbon atoms and 3 short alkyl groups each of which contains no more than about 2 carbon atoms, the total number of carbon atoms being from about 13 to about 17.

2. The composition of claim 1 wherein said anionic surfactant is selected from the group consisting of alkali metal salts of $C_{11-13}$ alkyl benzene sulfonates, $C_{14-18}$ alkyl sulfate, and mixtures thereof.

3. The composition of claim 2 containing from about 18% to about 40% of said anionic surfactant.

4. The composition of claim 3 containing from about 0.5% to about 1% of said water soluble quaternary ammonium salt.

5. The composition of claim 1 containing from about 0.5% to about 1% of said water soluble quaternary ammonium salt.

6. The composition of claim 5 wherein said water soluble quaternary ammonium salt is applied to the surface of said granular detergent composition as an aqueous solution containing from about 25% to about 70% of said salt.

* * * * *